US007950936B2

(12) United States Patent
Wang et al.

(10) Patent No.: US 7,950,936 B2
(45) Date of Patent: May 31, 2011

(54) ELECTRICAL CONNECTOR CONFIGURED WITH PIVOTAL COVER MEMBER

(75) Inventors: Ning Wang, Kunshan (CN); Chun-Sheng Li, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/512,331

(22) Filed: Jul. 30, 2009

(65) Prior Publication Data

US 2010/0159720 A1 Jun. 24, 2010

(30) Foreign Application Priority Data

Dec. 23, 2008 (CN) ..... 200810306459

(51) Int. Cl.
*H01R 13/44* (2006.01)

(52) U.S. Cl. ..... 439/144; 439/344; 439/490

(58) Field of Classification Search ..... 439/144, 439/344, 372, 676, 929, 490
See application file for complete search history.

(56) References Cited

U.S. PATENT DOCUMENTS

| | | | | |
|---|---|---|---|---|
| 5,634,802 | A * | 6/1997 | Kerklaan | 439/131 |
| 5,679,013 | A * | 10/1997 | Matsunaga et al. | 439/144 |
| 5,871,364 | A * | 2/1999 | Shinchi et al. | 439/144 |
| 6,142,834 | A * | 11/2000 | Liao | 439/676 |
| 6,398,564 | B1 * | 6/2002 | Wong | 439/131 |
| 6,478,610 | B1 * | 11/2002 | Zhou et al. | 439/490 |
| 6,971,921 | B1 * | 12/2005 | Lai | 439/676 |
| 7,074,061 | B1 * | 7/2006 | Roth et al. | 439/131 |
| 7,331,812 | B2 * | 2/2008 | Nishio et al. | 439/342 |
| 7,841,876 | B2 * | 11/2010 | Lin et al. | 439/144 |

* cited by examiner

*Primary Examiner* — Neil Abrams
(74) *Attorney, Agent, or Firm* — Andrew C. Cheng; Wei Te Chung; Ming Chieh Chang

(57) ABSTRACT

An electrical connector adapted for being mounted on a printed circuit board includes a base member loaded with a plurality of contacts therein and defining a mounting face confronting with the printed circuit board on which the base member is mounted, a cover member pivotally supported at a rear end of the base member and rotating between a closed position and an opened position. The cover member covers on the base member in a closed position and rotates to the opened position to define a mating cavity adapted for receiving a counter connector. The mating cavity includes a first mating face defined on the base member and parallel to the mounting face and a second mating face defined on the cover member defined on the cover member and parallel to the mounting face.

13 Claims, 9 Drawing Sheets

ELECTRICAL CONNECTOR CONFIGURED WITH PIVOTAL COVER MEMBER

BACKGROUND OF THE INVENTION

1. Field of the Invention

The present invention relates to a jack-type electrical connector, which has a base member loaded with contacts and a cover member pivotally supported on one end of the base member, whereby the cover member can be freely opened and closed.

2. Description of the Related Art

U.S. Pat. Issue No. 5,679,013 discloses a jack-type electrical connector, which has a base member and a cover member pivotally supported on one end of the base member so that the cover member can be freely opened and closed. An receiving space is provided between the base member and the cover member under an opened state of the cover member when the cover member is located at an opened position. The receiving space flares upwards for receiving an inserted plug connector, with respective to a bottom mounting face of the base member. Applicants believe said type connector still occupies a larger space.

BRIEF SUMMARY OF THE INVENTION

It is an object of the present invention to provide an electrical connector which occupies a smaller space.

In order to achieve the objective above, an electrical connector adapted for being mounted on a printed circuit board comprises a base member loaded with a plurality of contacts therein and defining a mounting face facing with the printed circuit board on which the base member is mounted, a cover member pivotally supported at a rear end of the base member and rotates between a closed position and an opened position. The cover member covers on the base member in a closed position and rotates to the opened position to define a mating cavity adapted for receiving a counter connector. The mating cavity includes a first mating face defined on the base member and parallel to the mounting face and a second mating face defined on the cover member defined on the cover member and parallel to the mounting face.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

Figure 1:
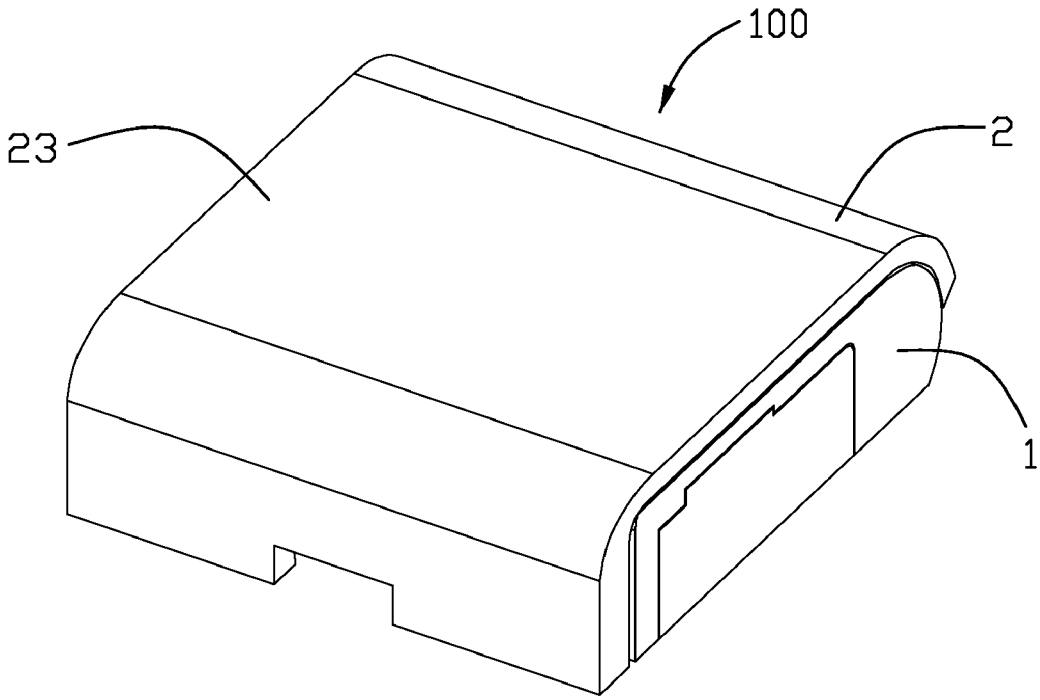
FIG. 1 is a top and front perspective view of an electrical connector in a closed position according to the embodiment of the present invention.
Figure 2:
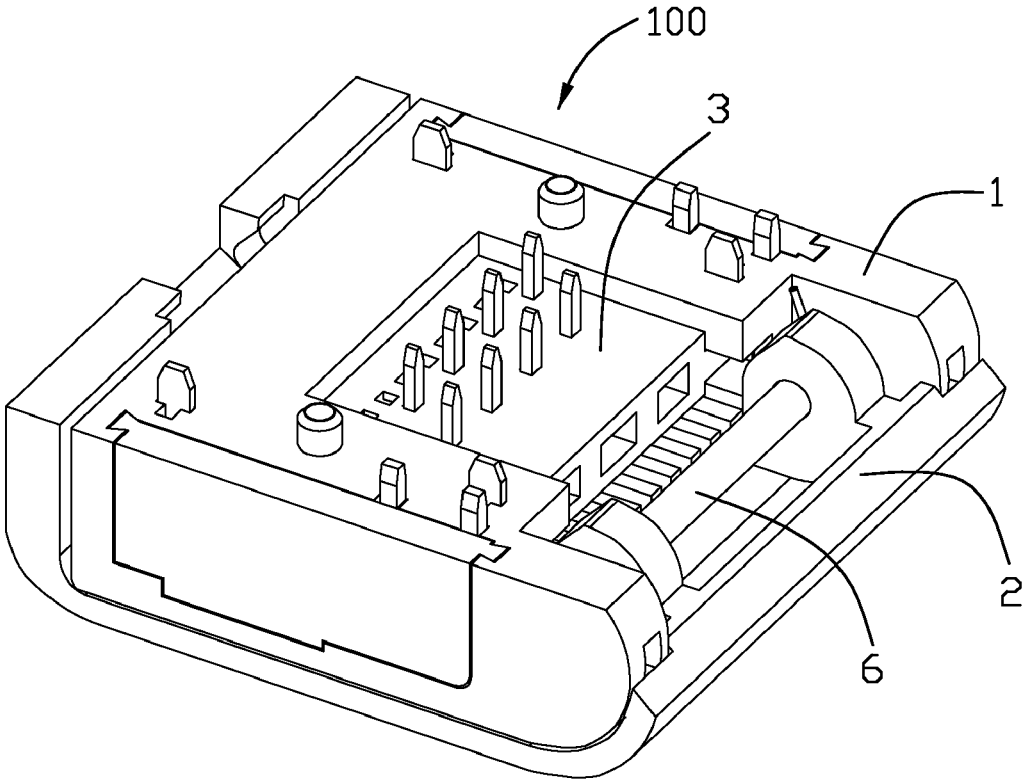
FIG. 2 is a bottom and rear perspective view of the electrical connector.
Figure 3:
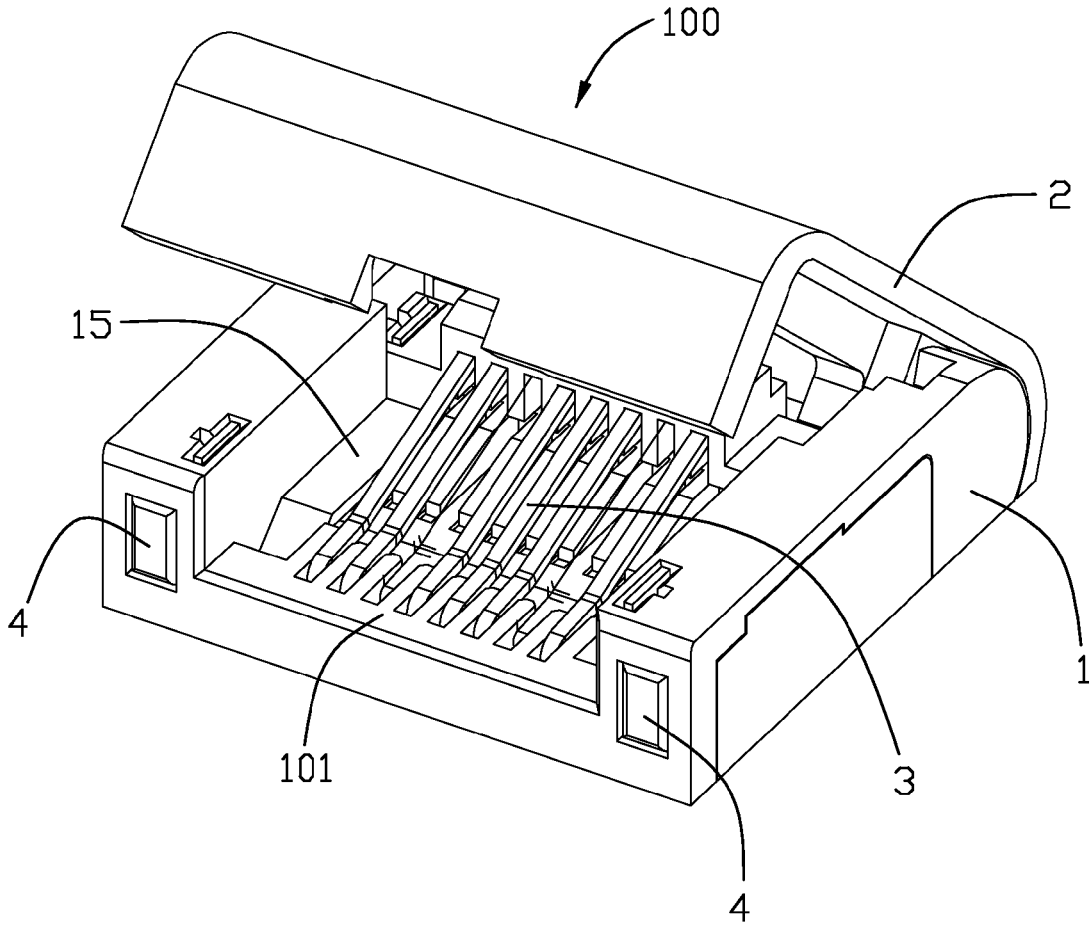
FIG. 3 is a perspective view of the electrical connector in an open position.

Please refer to figures, an electrical receptacle connector 100 according to one embodiment of present invention is used to mate with a counter connector 200 which is a standard modular jack connector such as RJ11, RJ45. As shown in FIG. 1 through 3, the connector 100 mainly includes a base member 1 loaded with a contact module 3 and a cover member 2 pivotally assembled on one end of the base portion by a shaft 6. In a non-used condition, the cover member 2 is cover on the base member 1 in a closed position as shown in FIG. 1 and the contacts hide in the connector in which the contacts are inaccessible. The counter connector 200 can be inserted into the connector when a user slightly rotates the cover member 1 upwards to an opened position as shown in FIG. 3 creating a receiving space for an inserted plug connector 200.

Figure 4:
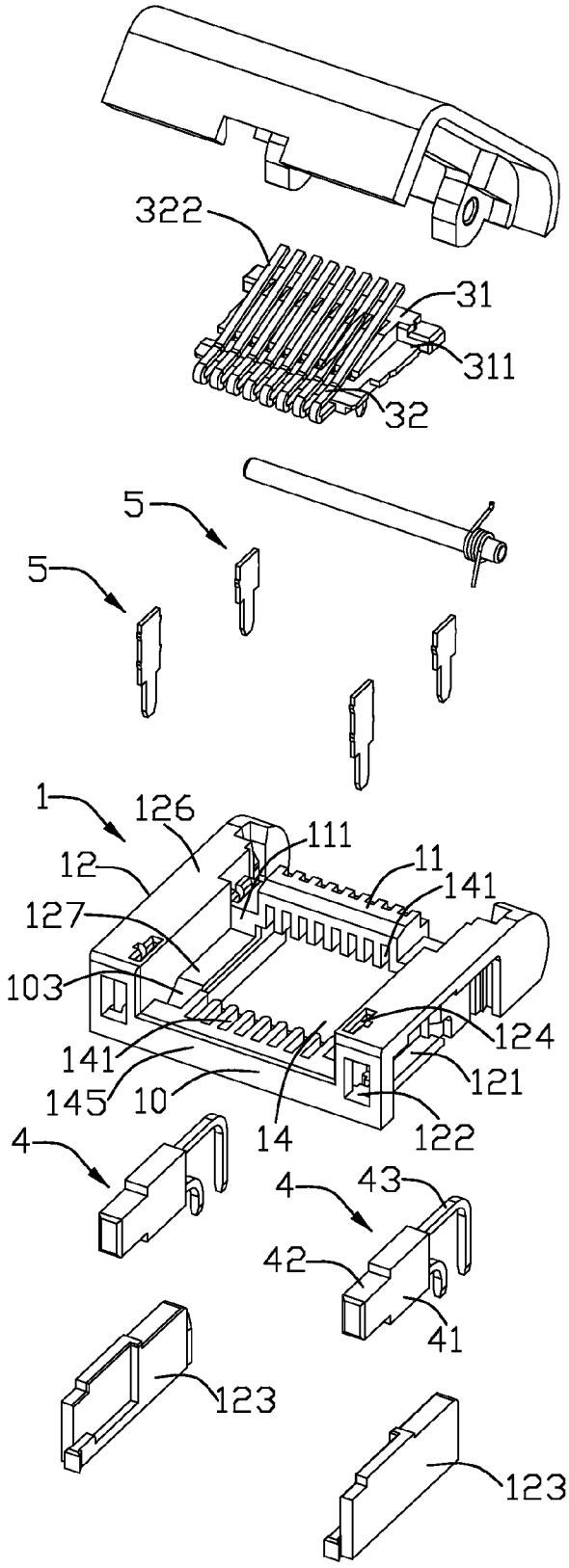
FIG. 4 is an exploded perspective view of the electrical connector shown in FIG. 3.
Figure 5:
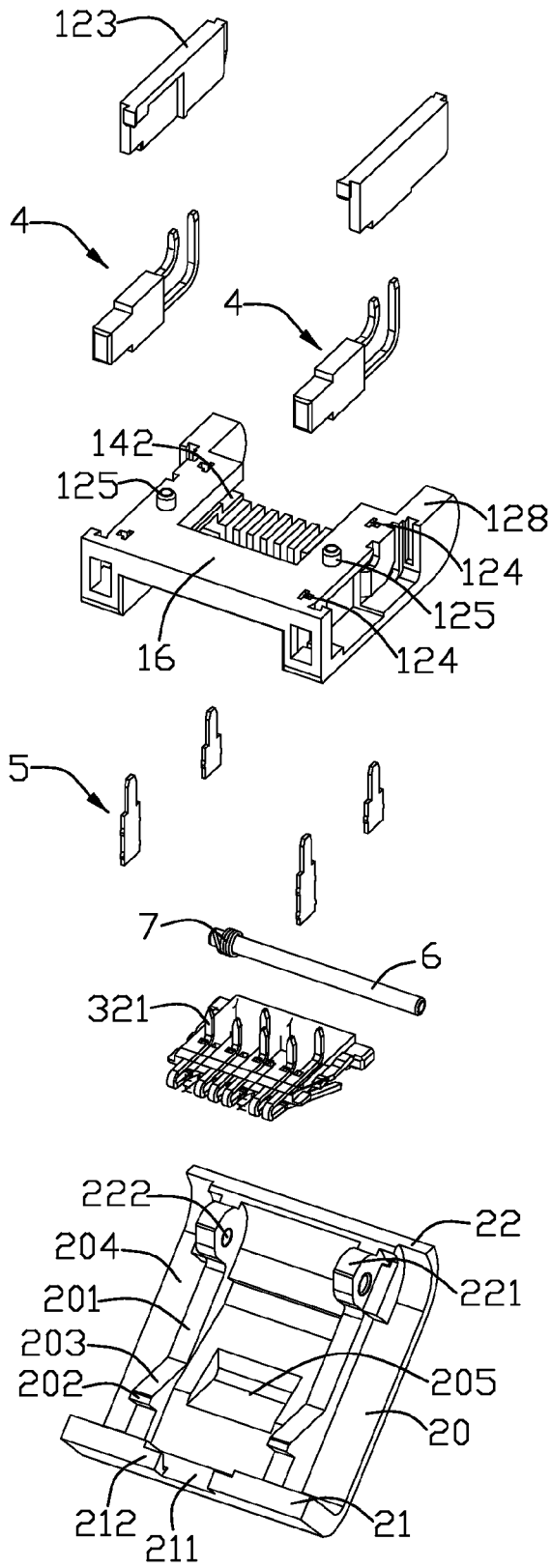
FIG. 5 is an exploded perspective view of the electrical connector in a bottom view.

Refer to FIGS. 4 and 5, the base member 1 made from insulating resin defines a bottom wall 10, a pair of sidewalls 12 and a rear wall 11. The bottom wall 10 defines a through cavity 14 to receive the contact module 3. The plastic board 31 of the contact module 3 is retained in the cavity 14 by a pair of retaining ribs 311 on lateral edges of the plastic board 31 being inserted and retained in corresponding slits 142 on inner face of the cavity 14. A plurality of contacts 31 are inserted molded in the plastic board 31 and have contacting portions 322 extending upward and rewardly and leg portions 321 perpendicular and downwards extending. The bottom wall 10 defines passageways 141 at a front end and a rear end thereof to receive and limit corresponding front ends and rear end of the contacts 32.

The sidewalls 12 define a pair of grooves 121 opening outwards to receive a pair of LED devices 4. A body portion 41 of the LED device is inserted into the groove 121 laterally and then moves forward so that a head 42 of the LED device projects into an opening 122 running through a front face of the sidewall. Rear legs 43 extend downwards. A pair of protecting covers 123 is laterally assembled to the sidewalls to protect the LED devices 4. Four metal ears 5 are inserted in corresponding holes 124 defined on the sidewalls 12, 13 and extend beyond the bottom face of the base member 1 to connect with a printed circuit board 300.

The sidewalls 12, 13 have rear ends 128 beyond the rear wall 11 on each of which defines a shaft hole (not labeled). The cover member 3 is assembled to the base member 1 by means of a pin shaft 6 rotationally received in the shaft holes) and a torsion spring 7 rings on one end of the shaft 6 and two ends of the torsion spring 7 abuts against the cover member so that the cover member 3 can restore to the closed position when the counter connector 300 is pulled out of the connector. The rear end of the cover member 3 is received between the two rear ends 128 of the sidewall 12 and behind the rear wall 11 when the cover member is in the opened position.

Figure 7:
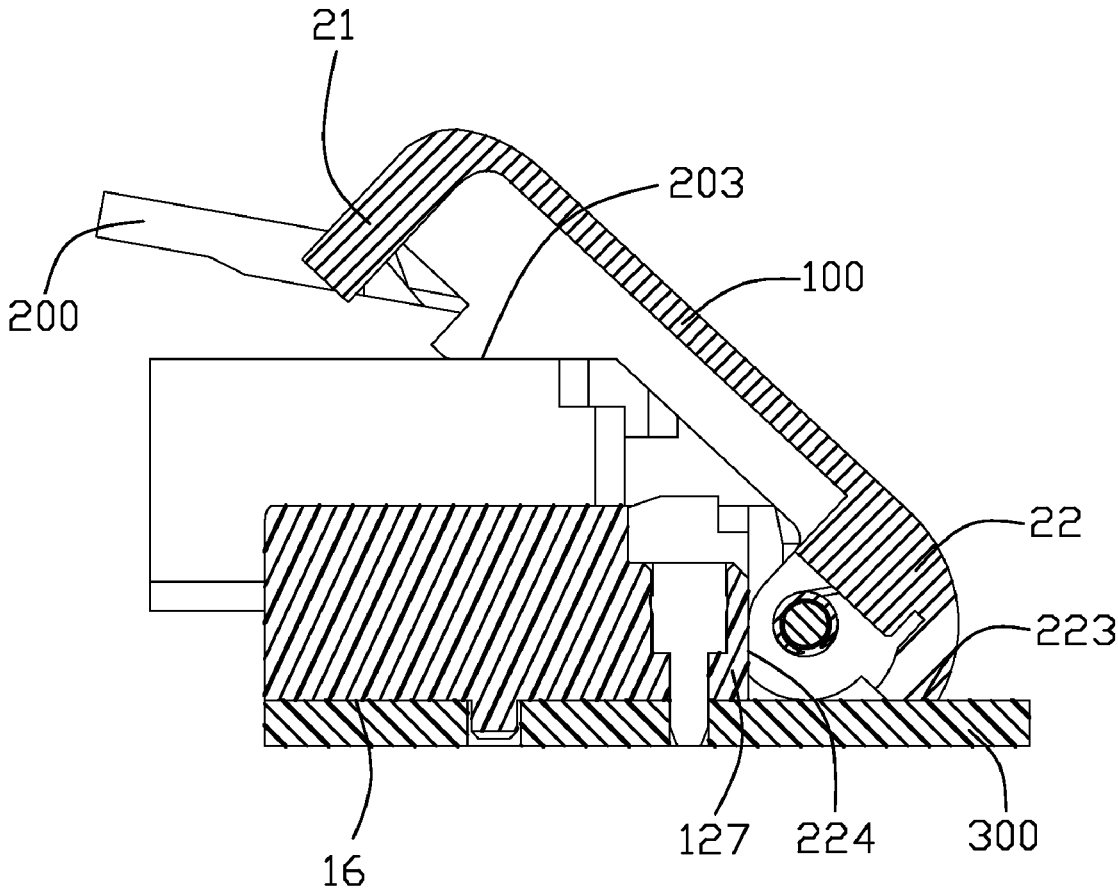
FIG. 7 is a cross-section view of the electrical connector taken along line 7-7 of FIG. 6.

The bottom wall 10 of the base member 1 has a pair of sides portions 127 beside the through cavity 14 along a mating direction and a front portion 145 having a same top face with the side portions 127. A V-shaped recess 103 is defined at the joint of the side portion 127 and the front portion 145. The cover member 3 includes a cover portion 20, a front curtain portion 21 bent from one end of the base portion and a rear curtain portion 22 bent from another end of the base portion 20. As best shown in FIG. 7, the front curtain portion 21 cover on a front mating opening of the base member 21, i.e. the front portion 145 of the bottom wall and the rear curtain portion 22 covers a rear of the connector. A bottom face 223 of the rear curtain portion 22 confronts with a PCB 300 where the base member 1 are mounted and a front surface 224 of the cam portion 221 confronts with rear faces of the side portions 127 to prevent the cover member 1 from rotating rearwards overly.

Referring to FIG. 5, the cover member 1 has a top face 23 (numeral 23 labeled in FIG. 1) and an inner face/bottom face 204 opposite to the inner face 23. Two longitudinal rib 201 perpendicularly extending between the front and rear curtain portions 21, 22. The pair of cam portion 221 projects downward from the ribs 201 near to the rear curtain portion 22 and a pair of locking portion 202 project downward from the ribs near to the front curtain portion 21. The locking portions 202 has a wedge-shaped configuration and each has a slanting face 203 chamfering forwards. As shown in FIG. 1 through FIG. 3, when the cover member is in the closed position, the front curtain portion 21 covers on a front of the base member and the base portion 20 on the upward face of the base member 1, locking portions 202 are received in recesses 103 and contacts 32 hide in the connector and are protected from being contaminated by dust. When the cover member 1 rotates upwards to the opened position when the cover member 1 is rotated to the opened position, a mating cavity 15 is defined between the cover member and base member to receive the counter plug connector 200.

Figure 6:
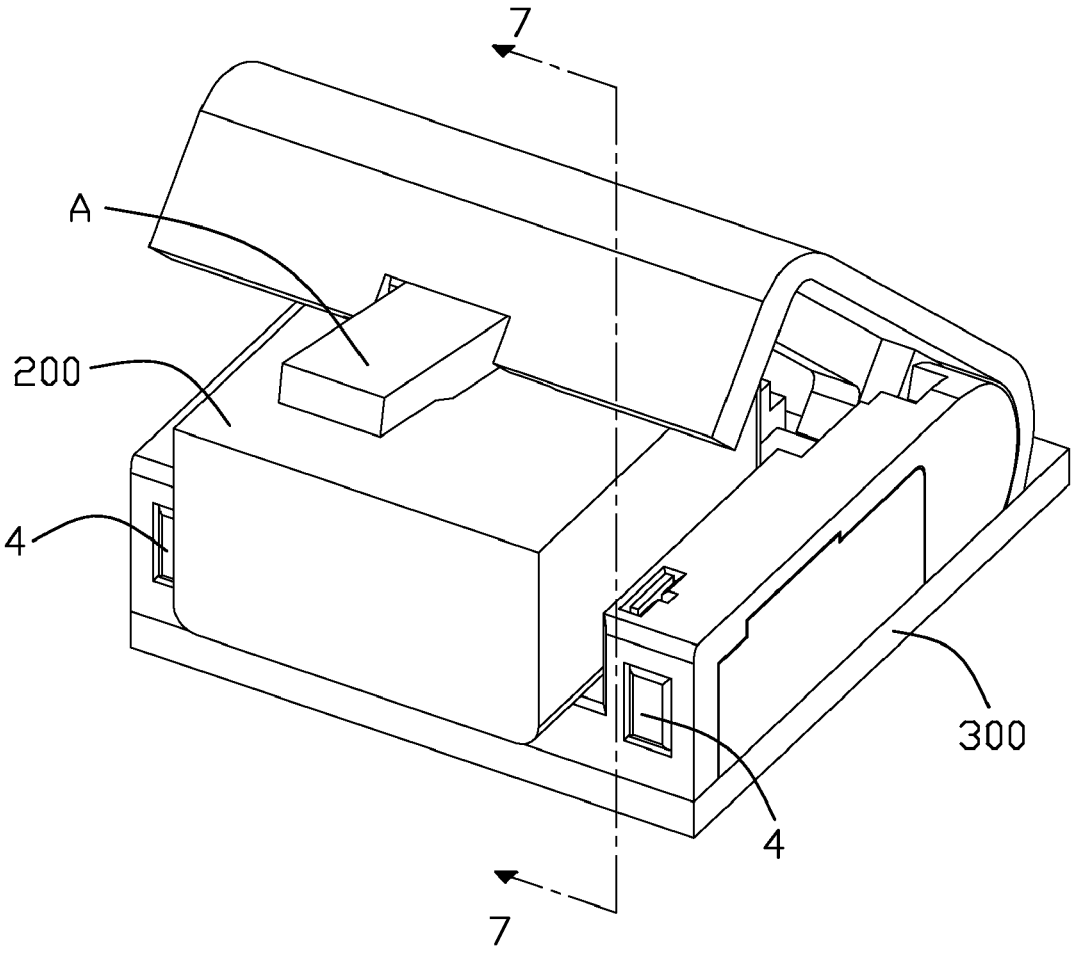
FIG. 6 is an exploded perspective view of the electrical connector inserted by a counter connector.

Referring to FIGS. 6 and 7 shown the insertion state of the counter plug connector 200 in the electrical connector 100 mounted on the PCB 300, the slanting face 203 of the cover member are parallel to a mounting face 16 of the connector. Combination with FIG. 3, the inserted counter connector 200 received in the mating cavity 15, is supported by and sandwiched between a first mating face 101 which is commonly defined by the top faces of the side portions 127 and the front portion 145 of the base portion and a second mating face 203, i.e. the slanting face 203. A third face 111 labeled in FIG. 4 is defined on a front face of the rear wall 11 preventing the counter connector from over-insertion. A latch A is inserted into a notch 211 opening downwards on the front curtain portion 211 and interlocked with a pair of projections 212 on two opposite insides of the notch 211.

Figure 8:
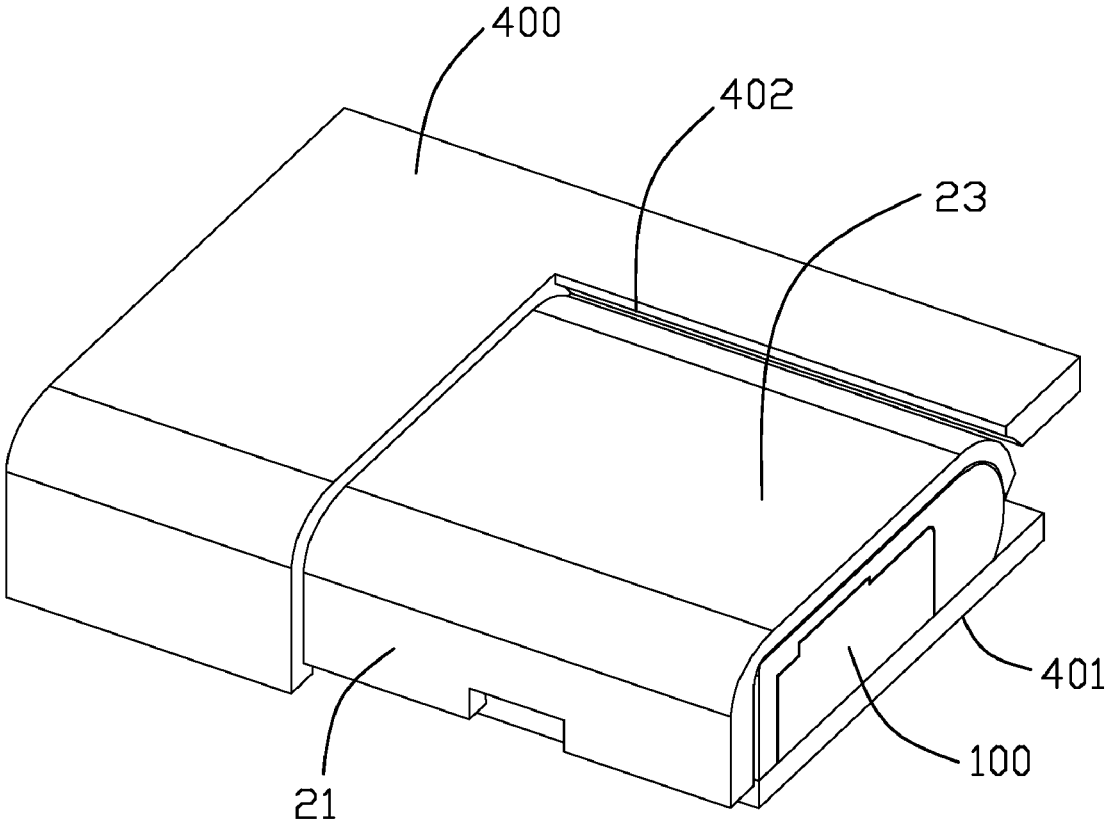
FIG. 8 is a perspective view of the closed electrical connector used in an electronic equipment.
Figure 9:
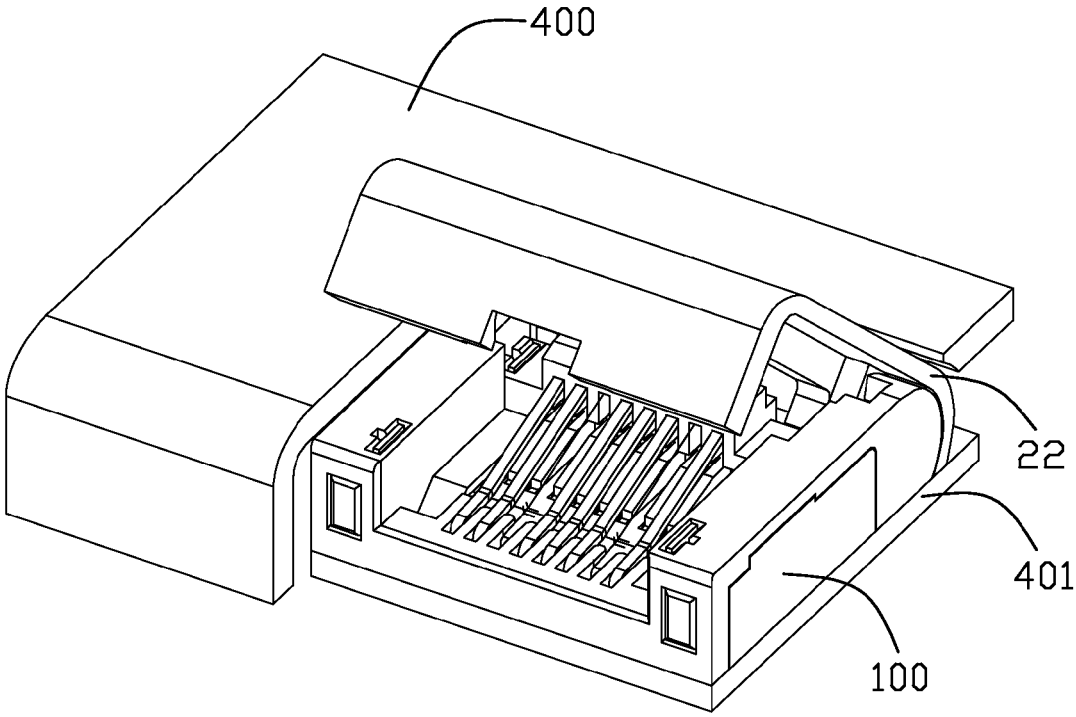
FIG. 9 is a perspective view of the open electrical connector used in the electric equipment.

Referring to FIGS. 8 and 9 shown a an illustrational view of connector 100 in an electric equipment 400, the electrical connector 100 are mounted on a PCB 401 in the electric equipment 400 and sunk in an notch 402 of the equipment 400. The exterior surfaces including a top surface (i.e. top face 23 of the cover member 2) and a front surface 21 (i.e. front face of the front curtain portion 21) of the connector 100 completes an exterior of the notch of the equipment 400 when the cover member rotates to cover on the base member in the closed position. In other words the top face 23 of the cover member is flushed with the notch 402 of the equipment, without occupying an outer space of equipment 400. The rear curtain portion 22 is partially received in the notch 402 and the counter connector 300 is inserted in the mating direction which is parallel to the PCB 401 and the mounting face 16. As a result, the connector in the opened position slightly higher than the counter connector 300 so that a total height of the assembly of the connector and the counter connector control in an ideal height.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for being mounted on a printed circuit board, comprising:

a base member loaded with a plurality of contacts therein and defining a mounting face confronting with the printed circuit board on which the base member is mounted;

a cover member pivotally supported at a rear end of the base member and rotating between a closed position and an opened position;

the cover member covering on the base member in the closed position and rotated to the opened position to define a mating cavity adapted for receiving a counter connector;

wherein the mating cavity comprising a first mating face defined on the base member and parallel to the mounting face, a second mating face defined on the cover member and parallel to the mounting face;

wherein the cover portion defines a rear curtain portion bending downward therefrom, a bottom face of the rear curtain portion abuts against the printed circuit board when the cover member is in the opened position to limit an over-rotation of the cover member.

2. The electrical connector as recited in claim 1, wherein the base member defines a bottom wall, a pair of side walls and a rear wall unitarily connected with each other and opening forwards and upwards, a top face of the bottom wall is defined as said first mating face on the cover member.

3. The electrical connector as recited in claim 2, wherein the cover member defines a pair of locking portions chamfering downwards to engage with a latch of the counting connector and received in recesses defined on the bottom face when the cover member is in the closed position, the locking portions each define an inward-facing slanting surface which is functioned as said second mating faces.

4. The electrical connector as recited in claim 3, wherein the cover member defines a pair of cam portions with shaft holes thereon so that the cover member is assembled on the base member by a shaft which is received in the shaft holes on the cover member and shaft holes on the base member.

5. The electrical connector assembly as recited in claim 4, wherein front faces of the cam portions abut against the rear wall when the cover member is in the opened position to limit the over-rotation of the cover member.

6. An electrical connector for use with a plug, comprising:

an insulative base member defining opposite front and rear ends thereof;

a plurality of terminals positioned on the base member;

a cover defining opposite front edge region and rear edge regions, said rear edge region being pivotally mounted at the rear end of the base so as to define said cover to be rotatable, relative to the base member, between a closed position, wherein the front edge region intimately confronts the front end, and an open position wherein the front edge region is spaced from the front end with a distance which is essentially equal to a thickness of said plug thus forming a mating port, into which said terminals extend, to allow said plug to be inserted thereinto horizontally for mechanically and electrically connecting to said terminals, wherein said cover defines a cutout in said front edge region for compliantly receiving an operation tip section of a deflectable latch of said plug therein so as to have said plug to be releasably latched to the cover wherein the cover defines a locking portion projecting towards the base from an under face thereof and received in a recess defined on the base member when the cover is in the closed position, the locking portion defines a first slant face to comply with a top face of a main body of said plug when the cover is in the closed position.

7. The electrical connector as claimed in claim 6, wherein the cover defines a cavity recessed at the under face thereof to receive a root section of the deflectable latch, the cavity defines a second slanting face to comply with the root section of the deflectable latch.

8. The electrical connector as claimed in claim 6, wherein said base member is further equipped with an LED unit which is visible when said cover is in the open position but is invisible when said cover is in the closed position.

9. The electrical connector as claimed in claim 8, wherein said LED is upwardly assembled to the base member from a bottom face of the base member, and a side protective cover is assembled to the base member and cooperates with said base member to retain the LED in the base member.

10. The electrical connector as claimed in claim 6, wherein said cover is equipped with a spring constant to urge said cover in the closed position.

11. The electrical connector as claimed in claim 6, wherein said terminals are formed on a terminal module assembled to the base member.

12. An electrical connector for use with a plug, comprising:

an insulative base member defining a mating port with a plurality of terminals therein and at least one LED device located beside said terminals in a transverse direction;

a cover pivotally mounted to a rear end of the base member and rotated between an open position where said cover is oblique to the base member and expose said mating port and the associated terminals, and a closed position where the cover is essentially parallel to the base member to enclose said mating port, wherein said mating port and the associated terminals are configured to only allow the plug to be inserted thereinto in a horizontal direction rather than an oblique direction so as to assure reliable upward support to said plug during mating;

wherein said cover shields the LED device in the closed position while exposing the LED device in the open position.

13. The electrical connector as claimed in claim 12, wherein said cover defines at least one oblique mating face in an under surface when said cover is in the closed position so as to provide a horizontal engagement face when said cover is in the open position for engagement with the plug which is horizontally inserted into the mating port.

* * * * *